US009816746B1

(12) United States Patent
Haney et al.

(10) Patent No.: US 9,816,746 B1
(45) Date of Patent: Nov. 14, 2017

(54) SLIDE OUT DOOR BIN

(71) Applicant: Whirlpool Corporation, Benton Harbor, MI (US)

(72) Inventors: Trevor Haney, Jenison, MI (US); Niyaz Ul Haque, Pune (IN); Bhushan Chandrakant Kadu, Nagpur (IN); John Jay Myers, Saugatuck, MI (US); Amit Prakash Powade, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/356,148

(22) Filed: Nov. 18, 2016

(51) Int. Cl.

| | |
|---|---|
| ***A47B 96/04*** | (2006.01) |
| ***F25D 23/02*** | (2006.01) |
| ***F25D 25/02*** | (2006.01) |
| ***F25D 11/00*** | (2006.01) |

(52) U.S. Cl.
CPC ..... *F25D 23/028* (2013.01); *F25D 11/00* (2013.01); *F25D 25/021* (2013.01); *F25D 25/024* (2013.01); *F25D 2323/023* (2013.01)

(58) Field of Classification Search
CPC .... F25D 23/028; F25D 25/021; F25D 25/024; F25D 11/00; F25D 2323/023
See application file for complete search history.

(56) References Cited

U.S. PATENT DOCUMENTS

| | | | | |
|---|---|---|---|---|
| 4,735,470 | A * | 4/1988 | Falk | F25D 25/021 312/246 |
| 4,751,826 | A * | 6/1988 | Kawahara | F25D 11/02 62/382 |
| 7,472,974 | B2 | 1/2009 | Czach et al. | |
| 8,424,985 | B2 | 4/2013 | Kwon et al. | |
| 8,702,185 | B2 * | 4/2014 | Chellappan | F25D 25/025 312/402 |
| 8,894,167 | B2 | 11/2014 | Lee et al. | |
| 8,960,824 | B2 | 2/2015 | Wilcox et al. | |
| 9,212,848 | B2 | 12/2015 | Kendall et al. | |
| 2006/0244350 | A1 * | 11/2006 | Martin | F25D 25/021 312/404 |
| 2006/0266070 | A1 * | 11/2006 | Ertz | F25D 23/021 62/441 |
| 2008/0168794 | A1 * | 7/2008 | Cho | F25D 23/025 62/441 |

(Continued)

*Primary Examiner* — Hanh V Tran
(74) *Attorney, Agent, or Firm* — Nyemaster Goode, P.C.

(57) ABSTRACT

A refrigeration appliance door bin assembly that includes: a refrigeration appliance door bin having a substantially planar main base portion, at least one upwardly extending wall that is free of an indentation, apertures or recesses extending upward from the main base portion and a downwardly extending perimeter lip portion where the main base portion and the downwardly extending lip portion define a downwardly facing door bin frame engagement space, the door bin engagement space engages a door bin frame of a refrigerator spaced within the door of a refrigerator such that the downwardly extending lip portion surrounds an exterior portion of the door bin frame and prevents substantial movement of the door bin when the door bin is engaged with the door bin frame caused by a refrigeration appliance door opening force or a refrigeration appliance door closing force; and a refrigeration appliance door bin bottom surface cover.

20 Claims, 10 Drawing Sheets

(56) References Cited

U.S. PATENT DOCUMENTS

| | | | | |
|---|---|---|---|---|
| 2009/0302724 | A1* | 12/2009 | Allard | F25D 17/042 312/237 |
| 2010/0019641 | A1* | 1/2010 | Laible | A47B 88/427 312/404 |
| 2012/0325827 | A1 | 12/2012 | Hauser et al. | |
| 2013/0026900 | A1* | 1/2013 | Oh | F25D 23/02 312/401 |
| 2014/0132143 | A1 | 5/2014 | Kim et al. | |
| 2014/0239790 | A1* | 8/2014 | Yoo | F25D 25/025 312/404 |
| 2014/0265800 | A1* | 9/2014 | Haltmeyer | F25D 25/025 312/404 |
| 2014/0265807 | A1 | 9/2014 | Kendall et al. | |
| 2014/0265808 | A1* | 9/2014 | Kendall | F25D 27/00 312/408 |
| 2015/0069066 | A1 | 3/2015 | Choi et al. | |
| 2016/0216027 | A1* | 7/2016 | Go | F25D 25/024 |
| 2017/0082351 | A1* | 3/2017 | Jung | F25D 11/02 |

* cited by examiner

SLIDE OUT DOOR BIN

BACKGROUND

Refrigerators are an essential part of kitchens around the world. Refrigerators are known in the art to have cooled storage chambers for preserving food, drinks, and other items that require cooling. These appliances typically provide multiple compartments for cooling items at different temperatures such as one or more refrigerator compartment and one or more freezer compartment. Within the compartment are specific storage areas such as crisper, baskets, shelves and door bins.

Door bins typically contain frequently used items such as drinks and condiments that may come in oddly shaped bottles. One type of refrigerator uses door bins that are fixed to the inner side of the door. In order to access the contents of a door bin users must open the door and remove the desired items, then transfer them to a flat surface like the table or counter. In another system the door bin may be accessed through a second outer door while the main refrigerator compartment door remains closed. The door bins of this type of system may include a solid base with upright projection that receives and engages mating indentation in the corresponding door bin. Not only do the mating indentation of the door bins take up valuable storage space within the door bin and make the door bin more difficult to clean, the door bins of these systems are constructed in a way that, when the door bin is removed and disengaged from the base to transport items in the door bin to another location (i.e. a table), the solid base remains and may appear to be a "shelf" to a user. This configuration allows users to use the solid base as a shelf. When a flat surface in such a configuration is used as a shelf, any items placed on the frame can easily fall when the outermost door of such systems is opened or closed. Items placed therein may fall out of or into the refrigerator and break or spill.

SUMMARY

One aspect of the present disclosure includes a door bin located in a main door and configured to pull out of the refrigerator through a second auxiliary door. The door bin is located on the door of an appliance and is accessible by opening the main door and by opening an auxiliary, outermost door. When accessed through the second door, the door bin may be laterally rolled/extended out and away from the standard storage position within the door, typically being a pair of glides. The door bin may also disengage the door of the refrigerator by hand and without the use of tools.

Yet another aspect of the present disclosure is generally directed to a refrigeration appliance door bin assembly that includes a refrigeration appliance door bin and a refrigeration appliance door bin bottom surface cover. The refrigeration appliance door bin includes: a substantially planar main base portion, at least one upwardly extending wall that is free of an indentation, apertures or recesses extending upward from the main base portion surrounding and thereby defining an interior volume of the refrigeration appliance door bin where the interior volume is sized to fit within a sub-volume within a larger volume of a door where the larger volume of the door is defined by a top wall, a bottom wall and two side walls of the door; and a downwardly extending perimeter lip portion. The main base portion and the downwardly extending lip portion define a downwardly facing door bin frame engagement space and the main base portion establishes the door bin frame cavity upper surface and the downwardly extending lip portion establishes an exterior surface of the door bin frame engagement space. The door bin engagement space engages a door bin frame of a refrigerator spaced within the door of a refrigerator such that the downwardly extending lip portion surrounds an exterior portion of the door bin frame and prevents substantial movement of the door bin when the door bin is engaged with the door bin frame caused by a refrigeration appliance door opening force or a refrigeration appliance door closing force. The refrigeration appliance door bin bottom surface cover is removably engaged with the refrigeration appliance door bin's substantially planar main base portion and spaced within the interior volume of the refrigeration appliance door bin. The refrigeration appliance door bin bottom surface cover is removable by hand and without the use of tools from the interior volume of the substantially planar main base portion. The refrigeration appliance door bin bottom surface cover covers at least one recess or aperture on a bottom of the refrigeration appliance door bin and the refrigeration appliance door bin bottom surface cover is engaged with at least a portion of the substantially planar main base portion.

A further aspect of the present disclosure is generally directed to an appliance that includes: a door bin frame further comprising at least one door bin frame support member that extends around and defines an aperture; and a door bin that includes: a substantially planar main base portion; an upwardly extending wall section extending upward from the substantially planar main base portion that surrounds and defines an interior volume of the door bin; and a downwardly extending perimeter lip portion. The main base portion and the downwardly extending lip portion define a downwardly facing door bin frame engagement space and the main base portion establishes the door bin frame cavity upper surface and the downwardly extending lip portion establishes an exterior surface of the door bin frame engagement space; the door bin engagement space engages a door bin frame of a refrigerator spaced within the door of a refrigerator such that the downwardly extending lip portion surrounds an exterior portion of the door bin frame and prevents substantial movement of the door bin when the door bin is engaged with the door bin frame caused by a refrigeration appliance door opening force or a refrigeration appliance door closing force; wherein the upwardly extending wall section is free of indentations or recessed portions configured to mate with a portion of an appliance and that project into the interior volume of the bin. The appliance cabinet has an interior storage area defined by at least a first side wall, a second side wall, a back wall, and a rotatably connected door system that includes a main cabinet door and an exterior door. The main cabinet door provides user access to the interior storage area of the appliance cabinet and wherein the exterior door provides access to the door bin when positioned within the rotably connected door system, but not unobstructed access to the interior storage area. The sliding mechanism assembly includes an interior facing bracket mounted to at least an interior facing surface of the main cabinet door and slidably engaged to a sliding mechanism, allowing the door bin to extend linearly outward.

Yet another aspect of the present disclosure includes a method for removing a door bin from a door frame where the method includes the steps of: providing a refrigerator comprising a cabinet, a main cabinet door for allowing access to an interior volume of the cabinet, wherein the main cabinet door defines an interior door volume and an exterior door that provides access to the interior door volume; selectively opening the exterior door such that a side of a door bin spaced with the interior door volume faces a user of the refrigerator or opening the main cabinet door such that an opposite side of the door bin faces the user of the refrigerator; sliding the door bin away from the interior of the cabinet when the exterior door is open, the door bin being removably engaged to a door bin frame attached to a sliding mechanism disposed within the interior door volume; and lifting the door bin by hand and without the use of tools from the door bin frame to disengage the door bin from the door bin frame and remove the door bin from the refrigerator. The method may also include the step of setting the bin on a surface that is not part of the refrigerator to provide convenient access to the door bin and the contents of the door bin. The door bin has a substantially rectangular cuboid shape where the sides of the door bin are free of any indentation, aperture or recess that mates with or engages a movable portion of an appliance.

The removable door bin systems of the present disclosure may also include a door bin with an interior volume that is defined by a planar base portion and at least one upwardly extending wall section that extends up from the planar base portion. The removable bin system also typically includes a door bin frame that can be connected and disconnected from the door bin and the door bin retained in engagement with the door bin frame using a downwardly extending lip portion of the door bin. The downwardly extending lip portion extends down from the planar base section of the door bin to create an engagement space that is sized to snugly surround an exterior portion of the door bin frame thereby preventing substantial lateral movement of the door bin when the door bin is connected with the door bin frame. Furthermore, the door bin frame defines a perimeter around at least one aperture. The aperture is typically sized to prevent users from placing items on the door bin frame when the bin is removed and may also prevent the user from perceiving the door bin frame as a shelf. Such a feature prevents items from being placed on the frame and falling into the refrigerator or out of the refrigerator due to the force of the outermost door on the main cabinet door being opened or closed.

The door bin may include a door bin bottom surface cover that is sized and shaped to cover any apertures in the bottom of the door bin frame. The bottom surface cover can be a plastic plate with a wooden finish to give the door bin an elegant look. Other finishes, such as a metallic or clear finish would also be possible.

In addition, at least the upwardly extending side wall sections of the door bin are free of indentations or recessed portions configured to mate with a portion of an appliance that project into the interior volume of the bin. Typically all upwardly extending wall sections of the door bin are free of indentations or recessed portions configured to mate with a portion of an appliance that project into the interior volume of the bin. In fact, all upwardly extending wall sections are typically free of any kind of indentation or recessed portions or apertures. This design allows the door bin to fit snugly within the door of the appliance while maximizing storage space within the bin and the interior volume of the appliance. In addition, the flat walls provide a more elegant look and easier to clean food, beverage or other debris than walls with a recessed portion.

The appliance door bin may be used in several applications. It may have use areas outside of refrigeration, like tool boxes, shelving, and file cabinets. The present disclosure should not be understood to be limited to use solely in a refrigerator or other appliance.

Another aspect of the present disclosure includes the appliance and the ability of the door bin to pull and extend the bin out laterally once an auxiliary door is in the open position. The door bin is engaged with the main door, but the outer, auxiliary door also provides direct access to the door bin without the main cabinet door being opened. The auxiliary door can share a hinge with the main door and open coaxially with the main door in order to rotate in the same axis as the main door, but this is not necessarily so. Conceivably, the two doors could rotate about different axes.

An appliance typically uses the door bin described above with the optional bottom surface cover. In addition, the appliance cabinet has an interior storage area defined by at least a first side wall, a second side wall, a back wall, and a rotatably connected door system. The rotatably connected door system may include a main door to access the interior storage area, and another auxiliary door that rotates in the same axis as the main door and provides access to the door bin. A sliding mechanism, which typically consists of a bracket mounted to first door and a slidably engaged track which allows the door bin to extend linearly out of the auxiliary door by at least about forty percent of the length of the mounting bracket for the bin glides that support the door bin frame to about one hundred percent from the primary storage position to an extended position. The extended position is typically an extension of at least about 2 inches and typically from about 2 inches to about 5 inches away from the primary storage position.

These and other aspects, objects, and features of the present disclosure and claimed invention will be understood and appreciated by those skilled in the art upon studying the following specification, claims, and appended drawings.

DETAILED DESCRIPTION OF EMBODIMENTS

Before the present disclosure is described further, it is to be understood that the present disclosure is not limited to the particular embodiments of the disclosure described below, as variations of the particular embodiments may be made and still fall within the scope of the appended claims. It is also to be understood that the terminology employed is for the purpose of describing particular embodiments/aspects, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in scope of the present disclosure.

In this specification and the appended claims, the singular forms "a," "an" and "the" include plural reference unless the context clearly dictates otherwise.

Figure 1A:
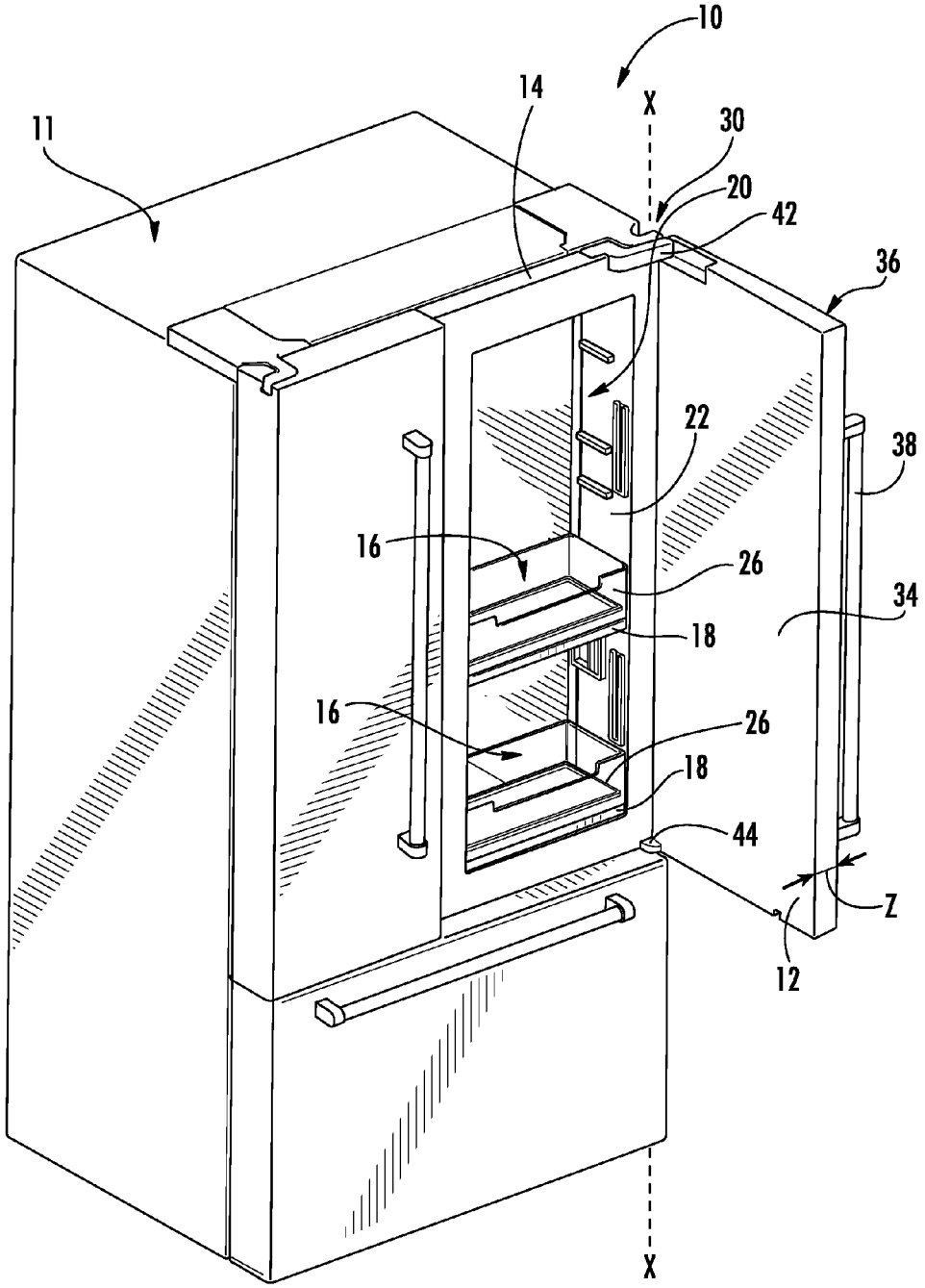
FIG. 1A is a perspective view of a refrigerator with the exterior, auxiliary door open with the door bin in the door bin storage position.

For purposes of description herein, the terms "upper," "lower," "right," "left," "rear," "front," "vertical," "horizontal," and derivatives thereof shall relate to the orientation shown in FIG. 1A. However, it is to be understood that various alternative orientations are also within the scope of the present disclosure, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1B:
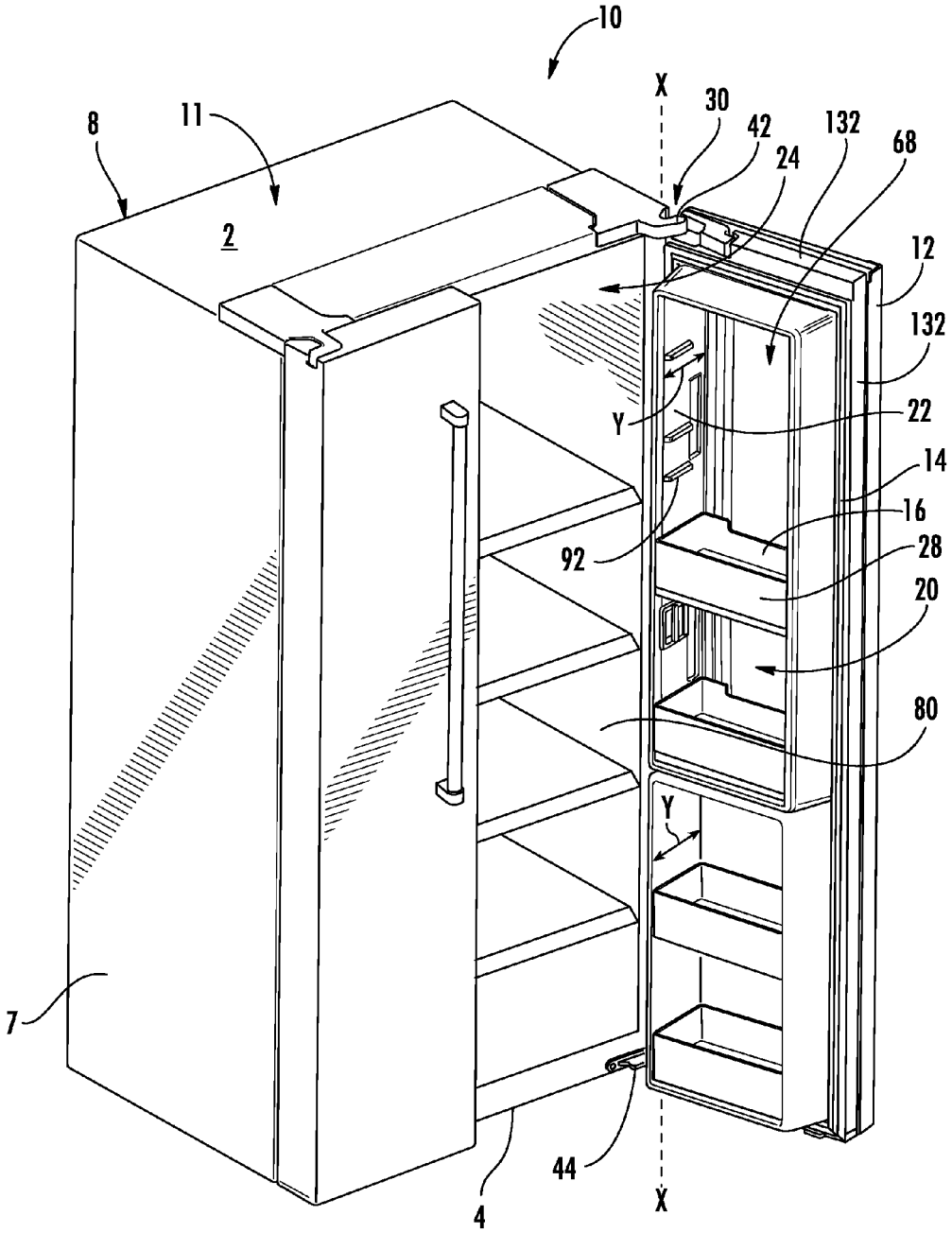
FIG. 1B is a perspective view of the refrigerator with the main cabinet door instead of the outermost door open according to another embodiment wherein the freezer compartment is located vertically next to the fresh food compartment.

Referring to FIGS. 1A and 1B, reference numeral 10 generally designates a refrigeration appliance 10. As shown in FIG. 1B, a cabinet interior volume 24 may be defined by a top wall 2, a bottom wall 4, a first side wall 6, a second side wall 7, a back wall 8, and a first door 14, which is a main, fresh food compartment or, less frequently, a freezer compartment access door. Cabinet interior volume 24 is located inside of cabinet 11 of refrigerator 10. FIG. 1 shows a French-door bottom mount configuration for a refrigerator, but it should be known to those within the art that this disclosure could apply to any number of refrigerator configurations such as side-by-side (see FIG. 1B), top-mount, bottom-mount, or any other configuration. In fact, the present disclosure should not be limited to an appliance, but the pull-out door bin could conceivably be used for a door bin spaced within any door with a main and secondary door access to allow access to both the front and back of the door bin depending upon which door is open.

The refrigerator 10 may have a fresh food compartment with a normal operating temperature above about 32° F. and a freezer compartment with a normal operating temperature of about 32° F. or below to hold foodstuffs, ice, or anything else that needs to be refrigerated at certain temperatures. The refrigerator may also have a door(s) 12 that provides selective access to the interior of the fresh food compartment or the freezer compartment, but does not open the first door to the fresh food compartment or freezer compartment. The refrigerator may also employ solely fresh food compartments or solely freezer compartments. Additionally, the appliance may have a single fresh food compartment or a single freezer compartment along with one or more main door 14. As seen in FIG. 1B, the door(s) 14 may have an inner liner that defines door interior volume 20 for the placement of storage devices such as bins 16, drawers, or the like. The door interior volume 20 may be isolated from the cabinet interior volume 24 having a separate duct to cool interior volume 20, the interior volume 20 may be not isolated and without any separate cooling, or any combination thereof. The doors 12 may be attached to the cabinet 11 via a hinge(s) 42, 44 disposed on the top and/or bottom of the doors 12. The hinges 42, 44 may be attached to the doors 12, 14 and rotationally coupled with the cabinet 11, or attached to the cabinet 11 and rotationally coupled with the doors 12 to allow the doors to rotate about an axis X (FIG. 1A) with respect to the cabinet 11 and allow a user access to the interior 24 of the cabinet 11 and to the interior volume 20 of the doors 12, 14.

Still referring to FIG. 1A, door bin(s) 16 may be located on a first door 14 in the interior volume 20 of the first door 14 between two upwardly extending and at least substantially parallel sides 22. There may be a second door 12, which is a door bin access door that does not allow unimpeded access to the fresh food compartment, disposed on first door 14. Second door 12 may be disposed coaxially with first door 14, but it should be known that first door 14 may also rotate about a second axis that may be parallel with, but at a spaced apart distance from the main door axis of rotation, or may be oblique to the main door axis of rotation. Door bin 16 may be disposed between first door 14 and second door 12. Front side 26 of door bin 16 can be accessed without opening first door 14 and allowing cooled air within the fresh food compartment to mix with ambient air by instead opening second door 12 to the front back side 26 of door bin 16 (FIG. 1B). Second door 12 provides easy access to door bin 16 and its contents and facilitates removal of door bin 16. First door 14 remains fixed while door bin 16 is rolled out and removed.

First door 14, shown according to one embodiment in FIG. 1B, may be generally rectangular with a perimeter portion 132 having a thickness Y of from about 1 inch to about 2 inches and a handle in FIB. 1B to open the first door 14 alone or in conjunction with second door 12. A first corner (the upper right corner of the door when closed as shown in FIG. 1B) of first door 14 may connect to top hinge 42 and a second corner (bottom right corner of the door when closed) of first door 14 may connect to bottom hinge 44 allowing first door 14 to rotate about axis X. Alternatively, first door 14 may rotate about separate hinges from second door 12. For example, the first door 14 may be mounted to the cabinet 11 with a top hinge and a bottom hinge and a second top hinge and a second bottom hinge may connect first door 14 and second door 12.

As shown in FIG. 1A, second door 12 may have front side 36 that faces outward and back side 34 that faces the interior volume 24 of the refrigerator 10. Door bin 16 may engage bin mounting protrusions 92 having a generally rectangular shape and constructed of plastic or other material. Bin mounting protrusions 92 may be formed on or engaged with door side wall 22 on an interior surface of the bin mounting protrusions 92 and may taper to a narrower cross section moving from the second door back side 34 toward the cabinet interior volume 24. The tapered shape may function as a stopper for door bin 16, so it may only roll out in one direction. In addition, the shape of the bin mounting protrusions may be rectangular, and the stopping function may be served with rubber stoppers or any other method known in the art. First door 14 may be made of a plastic or other insulating material to resist temperature change inside the refrigerator 10. First door 14 may be transparent, translucent, or opaque with a stainless steel, colored, or some other finish.

Second door 12 may be generally rectangular with a thickness Z of from about 0.5 inch to about 1.5 inches and be constructed of plastic with foam or other thermal insulation. The second door may also be constructed using any other materials or combination of materials known in the art such as those necessary to form a clear glass door to allow visual inspection of the door bin when second door 12 is closed. The second door 12 may connect to top hinge 42 along a top portion substantially near one side, and the second door 12 may connect to bottom hinge 44 along a bottom portion substantially near the same side, allowing second door 12 to rotate about axis X. Door to hinge connections may use a metal or bolt or screw to attach doors to hinges. Alternatively, connections may be made with any other connection known in the art. Hinges 42, 44 may be fixed to cabinet 11 with epoxy, screws, or any method known in the art. First door 14 may open with second door 12 as shown in FIG. 1B or second door 12 may open separately of first door 14 as shown in FIG. 1A.

Figure 2:
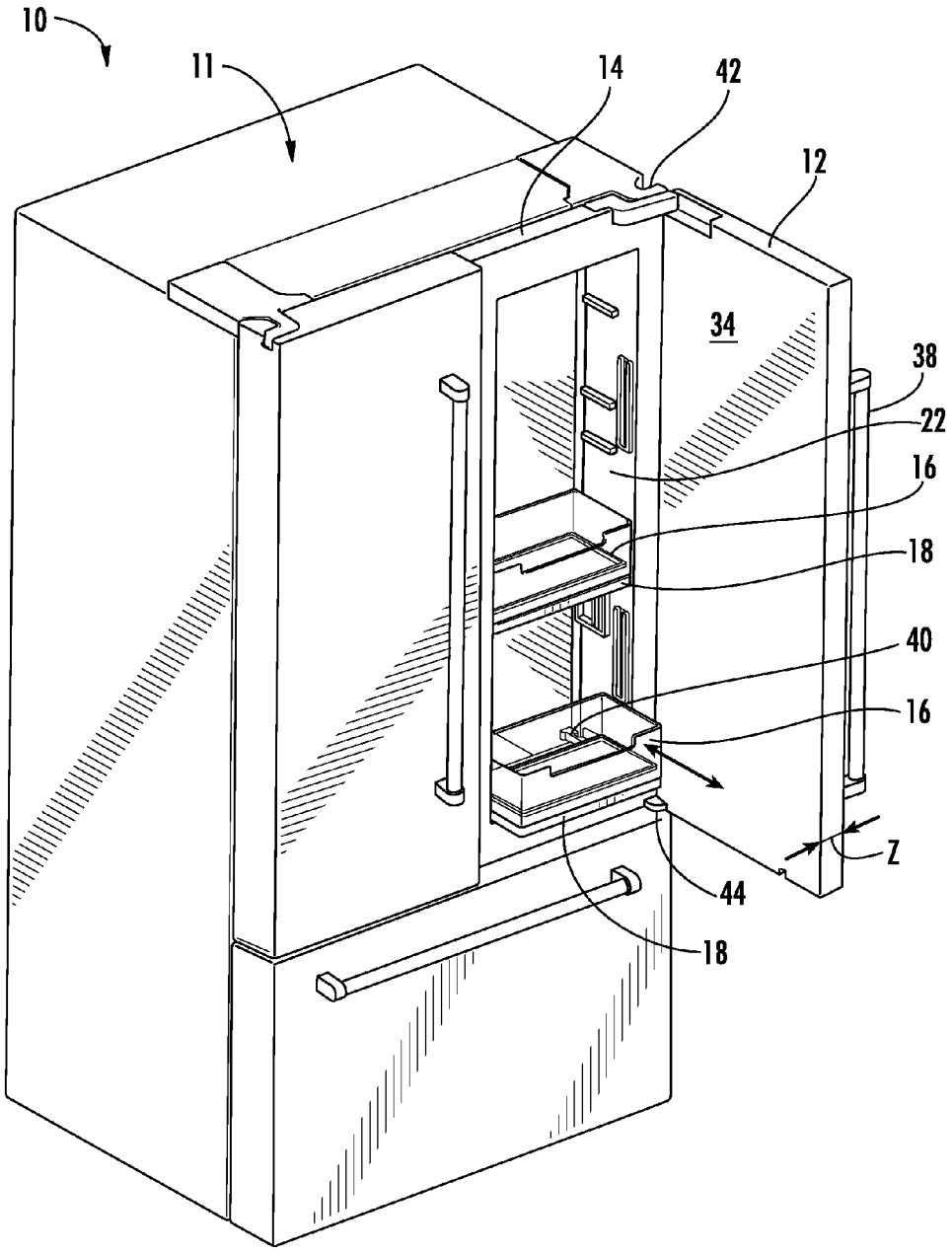
FIG. 2 is a perspective view of a refrigerator with the door open according to the first embodiment in which the pull-out bin can be seen to move outwardly in the sliding trim frame from the door bin storage position to the extended position.

Also seen in FIGS. 1A, 1B and 2, second door 12 may have front side 36 that faces outward and back side 34 that faces the interior volume 24 of the refrigerator 10. A handle 38 may be attached to the front side 36 of second door 12 to facilitate opening and closing the first door 14 and/or second door 12. Second door 12 may be made of a plastic or other insulating material to resist temperature change inside the refrigerator 10. Second door 12 may be transparent, translucent, or opaque with a stainless steel, colored, or some other finish, but, as mentioned above, is often opaque or has a central glass section that allows contents of the door bins to be seen.

Figure 3:
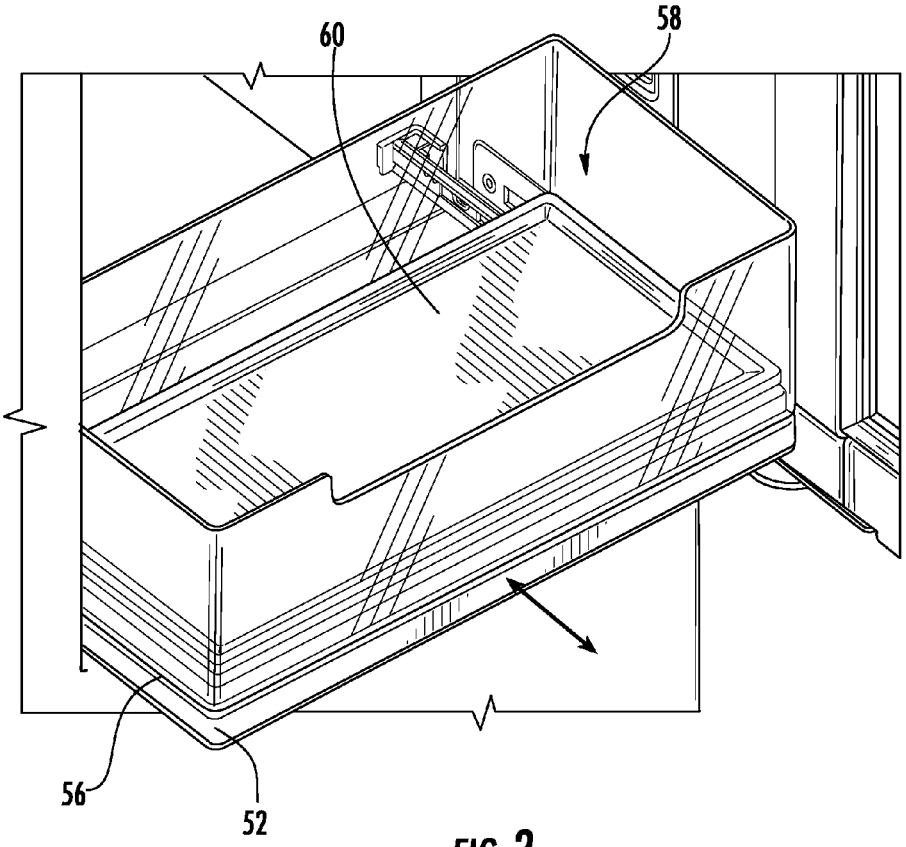
FIG. 3 is an enlarged perspective view of the door bin and the door bin frame.
Figure 4:
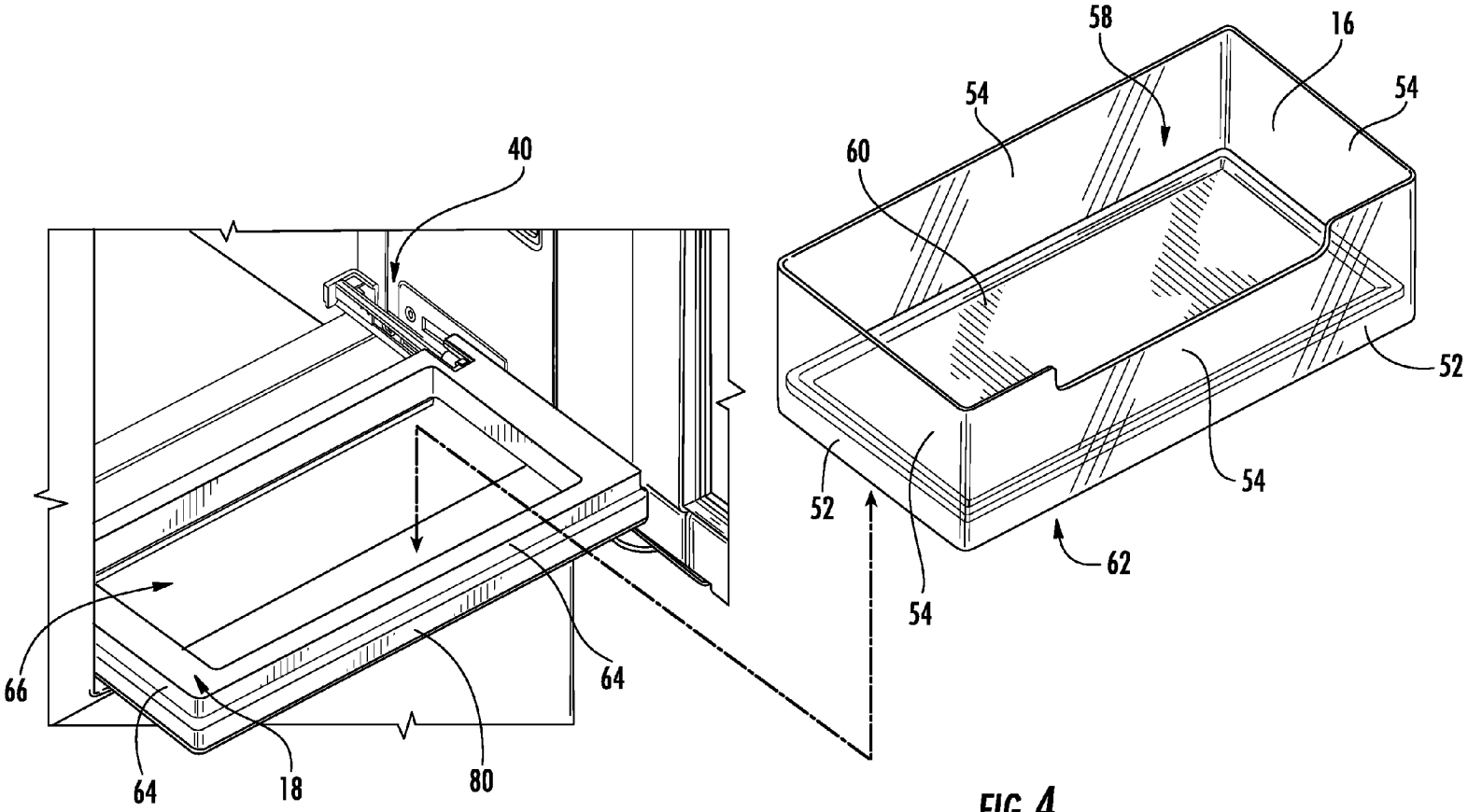
FIG. 4 is an enlarged perspective view of the door bin and the door bin frame in the extended position with the door bin disengaged from the door bin frame.
Figure 5:
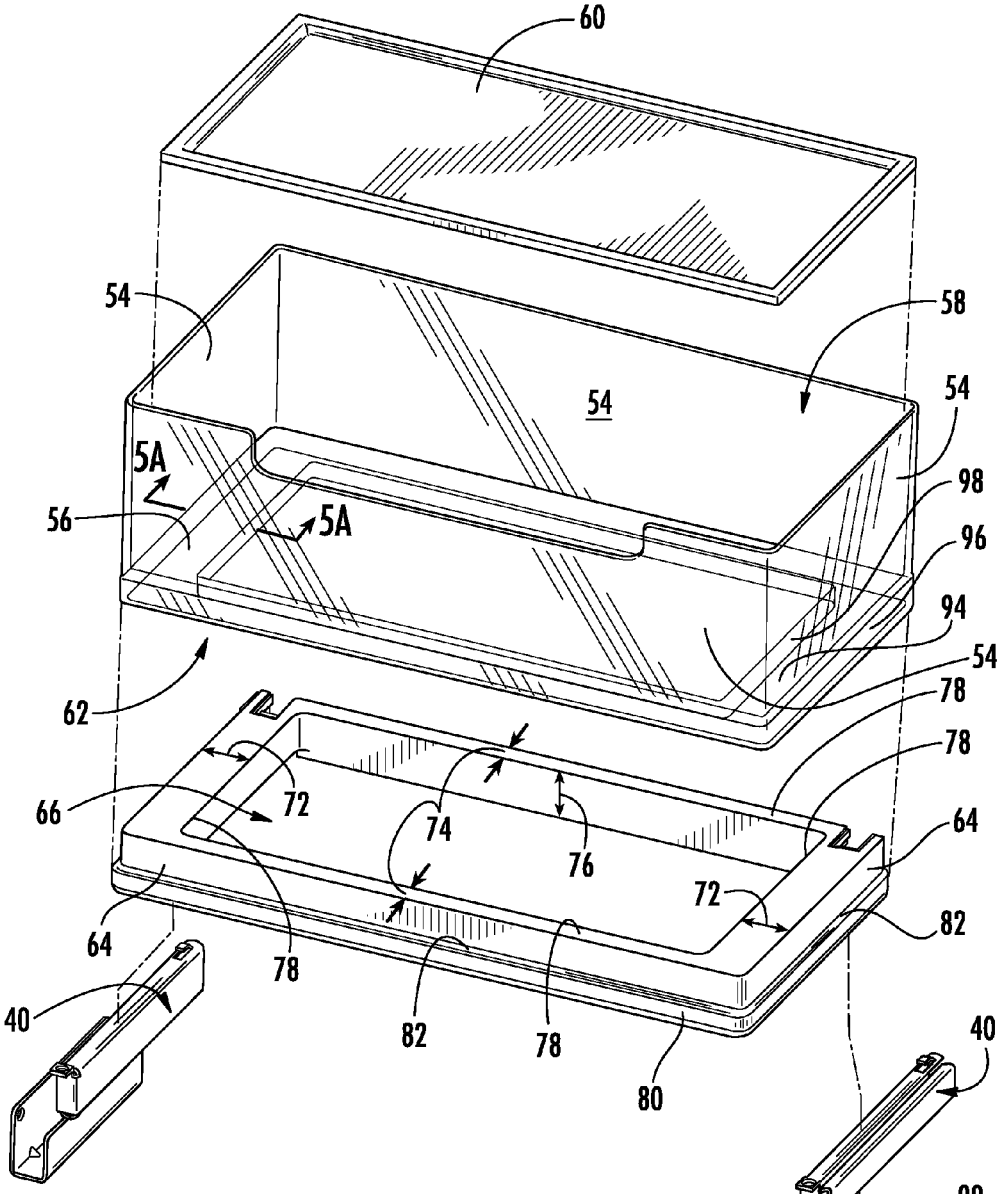
FIG. 5 is an enlarged, partially exploded, perspective view of the door bin in which the bottom surface cover has been removed from the door bin base and the door bin disengaged from the door bin frame.
Figure 5A:
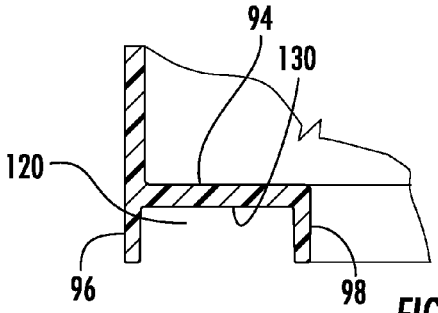
FIG. 5A is a cross-section taken along line 5A-5A in FIG. 5.

As seen in FIGS. 3, 4, and 5, door bin 16 may have door bin bottom surface cover 60, which sits atop door bin base portion 56 and comes in various styles, including wood grain, to give door bin 16 a more elegant look. Door bin bottom surface cover 60 is typically a separable insert that can be made of plastic, polymer, wood, or other material having a thickness of preferably less than about one half inch more typically about a quarter inch or less. Door bin bottom surface cover 60 is shaped and sized to fit inside door bin 16 and substantially cover door bin base portion 56, which extends around the perimeter of the door bin and is recessed away from the bottom perimeter edge 80 to form a perimeter lip 82. The door bin bottom surface cover 60 can be removed from the door bin by hand and without the use of tools. In one embodiment, the door bin bottom surface cover 60 covers aperture 66 of door bin frame 18. Although shown in FIGS. 5 and 5A as having a top ledge 94 and outside door bin frame retaining walls 96, which are a downwardly extending lip, and inside door bin frame retaining walls 98 that essentially straddle the door bin frame, the door bin 16 may also have solely outside door bin frame restraining walls 96 and a solid base that bridges across the aperture 66 of the door bin frame or a corresponding aperture to the door bin frame aperture that is covered by the door bin bottom surface cover 60. Upward extending wall 54 extends up from the base portion 56 to create a bin interior volume 58. Upwardly extending wall section 54 may be free of indentations, apertures, or recessed portions which are configured to mate with a portion of an appliance 10 that projects into the interior volume 58 of door bin 16. The wall sections 54 are typically completely flat sides without any apertures, indentations, or recesses. The base portion and the downwardly extending outside door bin frame retaining walls 96 define a downwardly facing door bin frame engagement space 120 and the base portion 56 establishes the door bin frame cavity upper surface 130 and the downwardly extending outside door bin frame retaining walls 96 establish the exterior surface of the door bin frame engagement space. The door bin engagement space engages the door bin frame 18 such that the downwardly extending outside door bin frame retaining walls 96 surrounds an exterior portion of the door bin frame and prevents substantial movement of the door bin caused by a refrigeration appliance door opening force or a refrigeration appliance door closing force when the door bin is engaged with the door bin frame.

Figure 9:
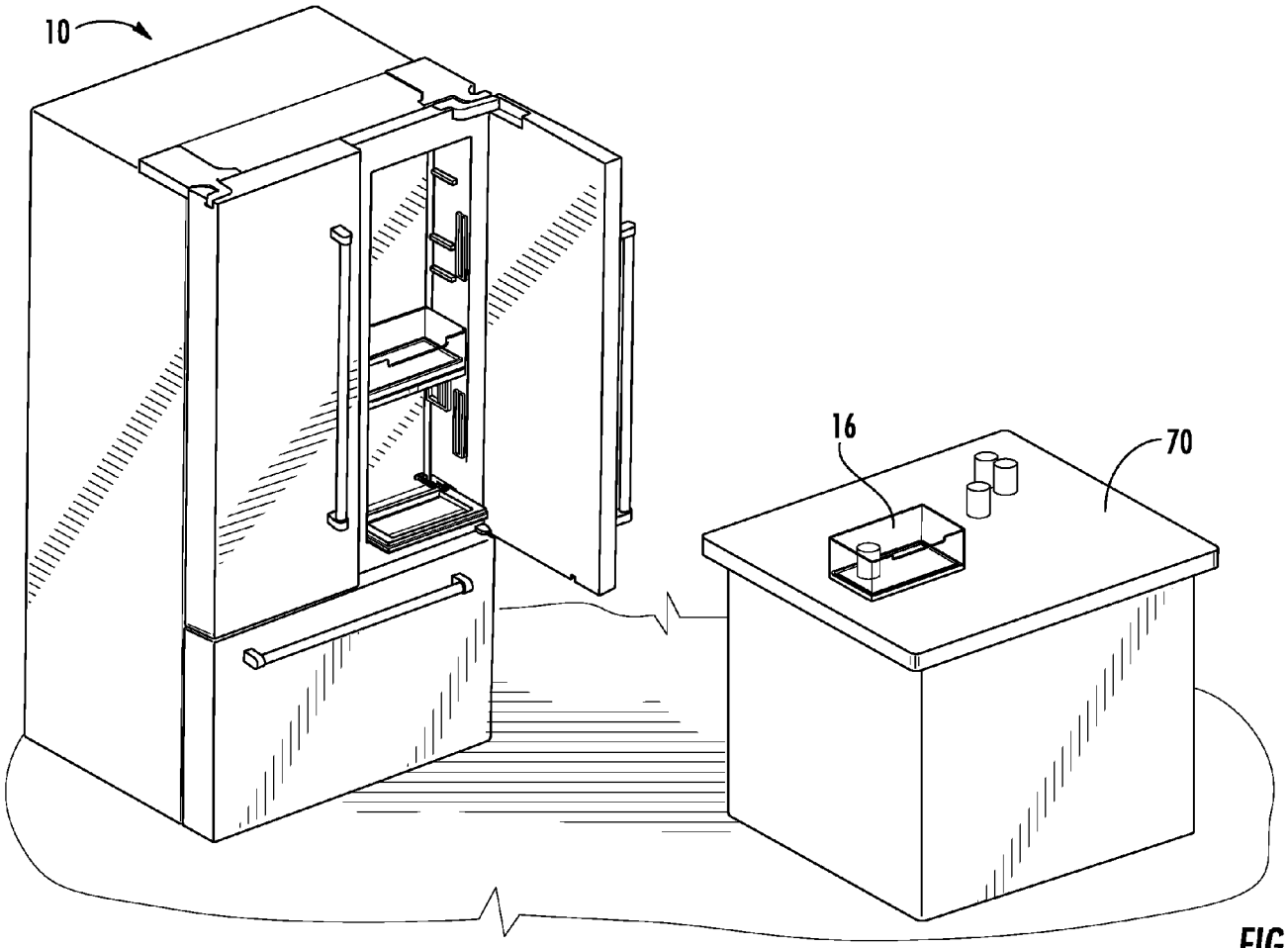
FIG. 9 is a perspective view of a refrigerator employing the slide out door bin showing how the door bin may be removed and carried to another surface such as a dining or food preparation surface.

As seen in FIG. 5, door bin 16 sits on door bin frame 18 and can be removed by hand and without the use of tools by lifting door bin 16 off of frame 18. The door bin can then be transported to another location such as a different door bin location within the appliance or set onto a substantially planar surface remote from the refrigerator like surface 70 (see FIG. 9), i.e. a dining table or countertop.

Door bin frame 18 may be of a generally rectangular shape with at least four sides that create aperture perimeter 78 around aperture 66. The at least four sides define aperture perimeter 78. The sides preferably have side frame width 72 of approximately 2 inches and front and rear frame width 74 of approximately 1 inch. The door bin frame typically has a height 76 of from about 1 inch to about 2 inches, more typically approximately 1.2 inches. Door bin frame 18 may be made of a substantially rigid material, typically a plastic or a wood material, and may be finished with chrome or other color.

Figure 6:
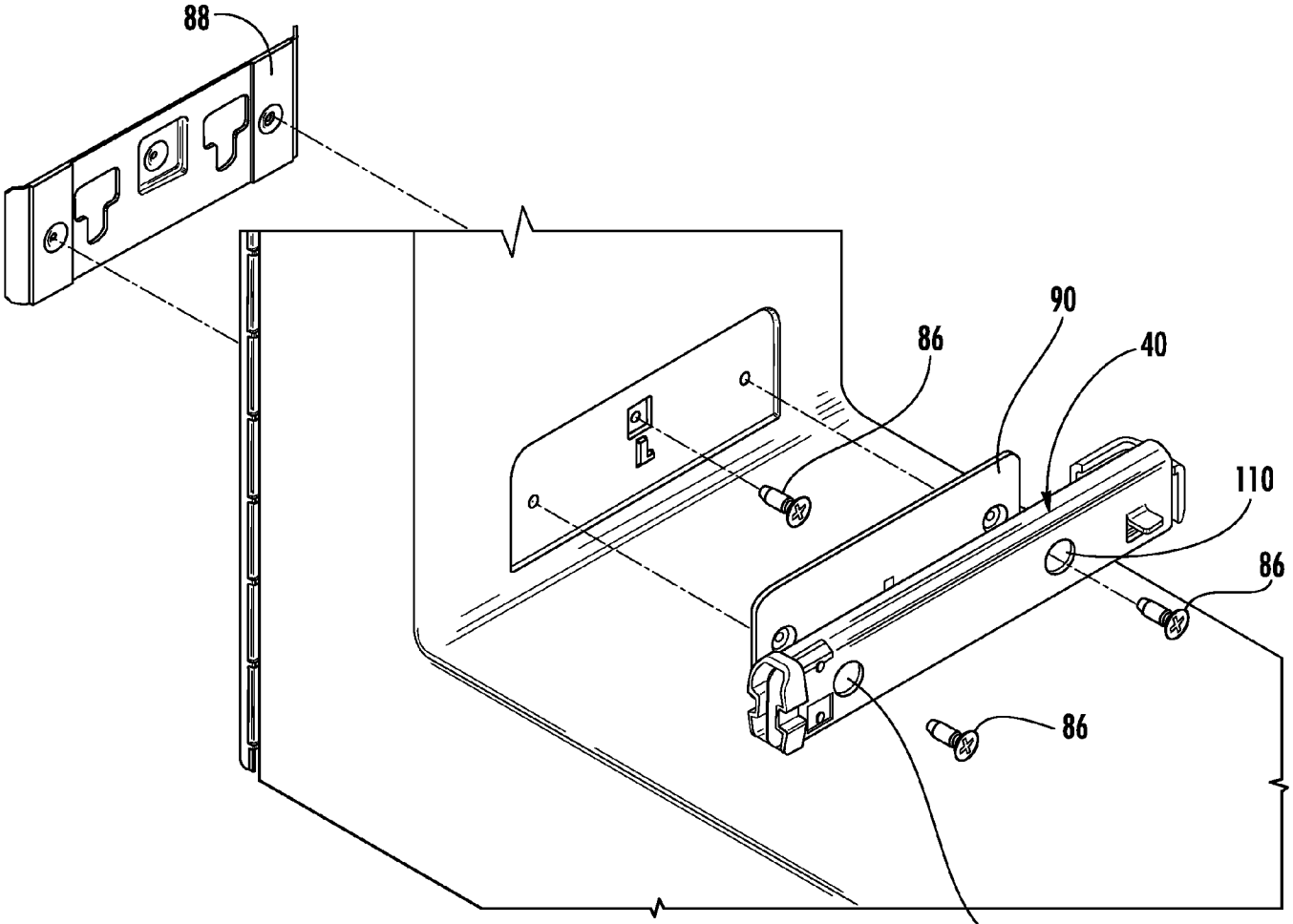
FIG. 6 is an enlarged, partially exploded, perspective view of the sliding mechanism and the exterior and interior mounting brackets.

As seen in FIGS. 4-6, to facilitate removal of door bin 16 and to provide easier access to the contents of the door bin 16 even if it is not removed, the door bin 16 and door bin frame move outward and inward. The door bin frame 18 can be attached to sliding mechanism 40 that allows door bin 16 and frame 18 to slide out of second door 12. Typically the door bin and frame can be extended anywhere from 40 percent to 100 percent away from the interior, storage space/location, more preferably by 50 to 80 percent when second door 12 is open. The percent extension is the lateral distance by which door bin frame 18 can extend on sliding mechanism 40. The percent is measured relative to the size of door bin 16. For example, if door bin 16 has a width of ten inches, one hundred percent extension would mean that door bin frame 18 could extend 10 inches from its initial, in-door storage position outward from second door 12 is open. Door bin frame 18 can be connected and disconnected from sliding mechanism 40.

Figure 7A:
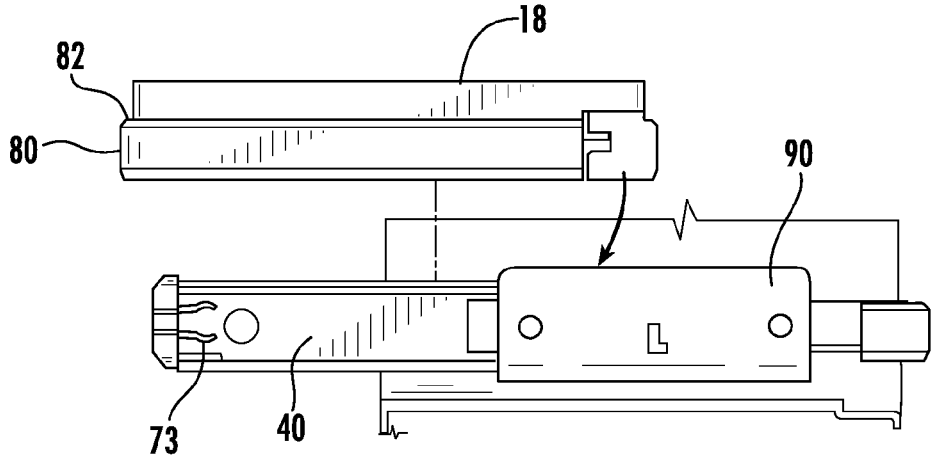
FIG. 7A is an elevated and partially exploded side view of the sliding mechanism and bracket with the door bin frame disengaged from the sliding mechanism.
Figure 7B:
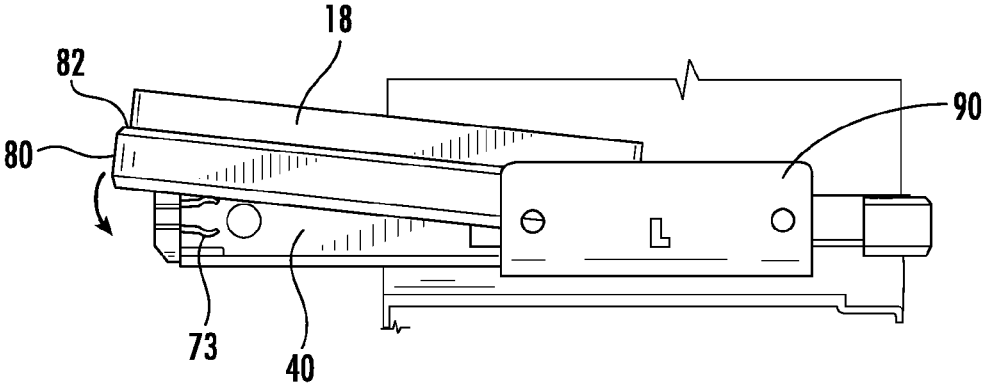
FIG. 7B is an elevated and partially exploded side view of the door bin frame beginning to be engaged with the sliding mechanism where the rearward side of the frame is initially engaged and the overall frame is positioned at an angle to the plane of the sliding mechanism.
Figure 7C:
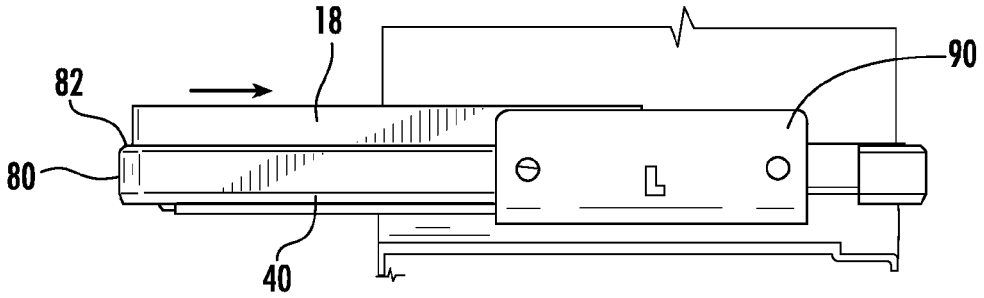
FIG. 7C is an elevated and partially exploded side view of the sliding mechanism engaged with the door bin frame after having been rotated downward and into at least a snap-fit or fastened engagement with the sliding mechanism.
Figure 8:
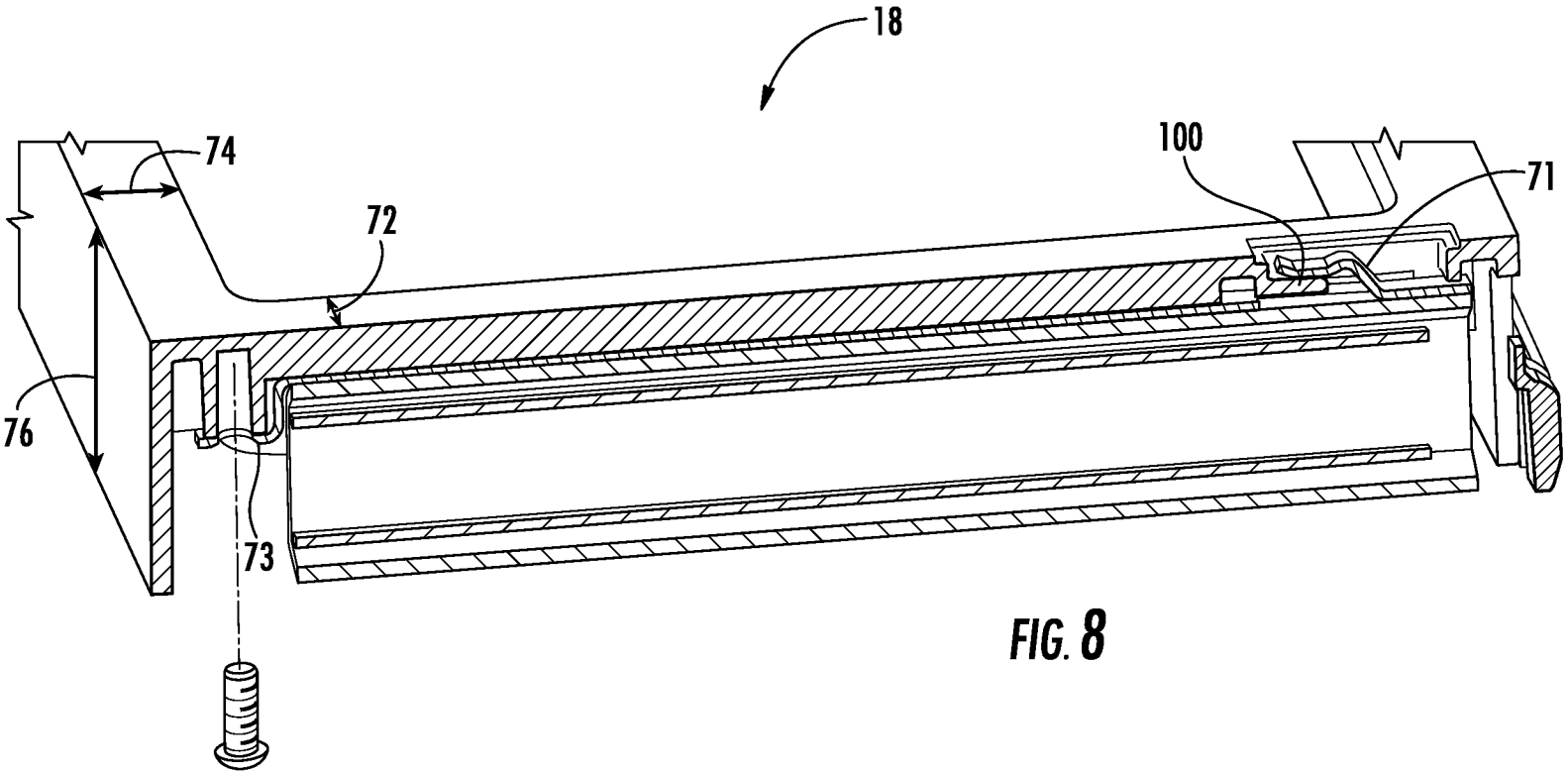
FIG. 8 is a cross-sectional view of a side of the door bin frame engaged with the sliding mechanism.

FIGS. 7A, 7B, 7C, and 8 show the sliding mechanism 40 and how it may connect to the door bin frame 18. FIG. 8 shows the door bin frame 18. A frame engaging tab 71 on the sliding mechanism 40 matingly engages with a frame tab 100. A spring clip 73 may be used to attach and detach door bin frame 18 from sliding mechanism 40.

To install the door frame into engagement with the sliding mechanism on each side of the interior surface/liner of the door, the door frame is inserted at an angle such that frame tab 100 is spaced under the frame engaging tab 71 of the sliding mechanism. Thereafter, the frame is dropped down into a snap-fit engagement with the spring clip 73. This process is shown generally in FIGS. 7A, 7B and 7C.

As shown in FIGS. 5-6, sliding mechanism 40 includes an inner member and an outer member with a bearing cage between them. The sliding mechanism is typically made of a rigid material like metal and can have a rectangular cross section with rounded corners having dimensions of approximately 5"×1"×0.5". The sliding mechanism and mounting assembly typically includes front bracket 90, back bracket 88, and sliding mechanism 40. Sliding mechanism 40 is fixed to front mounting bracket 90, which connects to door side wall 22 by screws 86. Back mounting bracket 88 is attached to the outer wall of first door 14 and connects to first door 14 with screw 86 that comes through first door 14 and into a threaded screw hole at the center of back bracket 88. Typically, as shown in FIG. 6, the sliding mechanism has one or more aperture 110 that allows for the screws 86 to be engaged with the front and back mounting brackets with the screwdriver passing through aperture(s) 110. FIGS. 7A, 7B, and 7C show an embodiment of a sliding mechanism that consists of two rails that may be slidably connected with bearings. However, the sliding mechanism 40 can be any sliding mechanism known in the art.

Door bin 16 may be engaged or disengaged from door bin frame 18. As discussed somewhat previously and as shown in FIG. 4, to facilitate engagement, door bin 16 may have perimeter lip portion 52 extending down from base portion 56 creating door bin engagement space 62. Frame exterior portion 64 fits within engagement space 62, typically in a mating engagement, to connect door bin 16 and door bin frame 18 when exterior portion 64 is surrounded by lip portion 52, thereby preventing substantial lateral movement of the door bin when the door bin is seated on the door bin frame. The snug fit between the exterior portion 64 and the lip portion 52 prevents substantial lateral movement, which is any significant movement of the door bin 16 such that could cause spilling or jarring of the contents of door bin 16 while sitting on door bin frame 18.

It will be understood by one having ordinary skill in the art that construction of the described devices and systems of the present disclosure and other components is not limited to any specific material. Other exemplary embodiments disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the present disclosure and claimed invention as shown in the exemplary embodiments are illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within the described processes may be combined with other disclosed processes or steps to form structures within the scope of the present disclosure and claimed invention. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A refrigeration appliance door bin assembly comprising:

a refrigeration appliance door bin comprising:

a substantially planar main base portion, at least one upwardly extending wall that is free of an indentation, apertures or recesses extending upward from the substantially planar main base portion surrounding and thereby defining an interior volume of the refrigeration appliance door bin wherein the interior volume is sized to fit within a sub-volume within a larger volume of a door where the larger volume of the door is defined by a top wall, a bottom wall and two side walls of the door; and a downwardly extending perimeter lip portion; and wherein the main base portion and the downwardly extending lip portion define a downwardly facing door bin frame engagement space and the main base portion establishes a door bin frame cavity upper surface and the downwardly extending lip portion establishes an exterior surface of the door bin frame engagement space; the door bin engagement space engages a door bin frame of a refrigerator spaced within the door of a refrigerator such that the downwardly extending lip portion surrounds an exterior portion of the door bin frame and prevents substantial movement of the door bin when the door bin is engaged with the door bin frame caused by a refrigeration appliance door opening force or a refrigeration appliance door closing force; and a refrigeration appliance door bin bottom surface cover removably engaged with the refrigeration appliance door bin's substantially planar main base portion and spaced within the interior volume of the refrigeration appliance door bin and wherein the refrigeration appliance door bin bottom surface cover is removable by hand and without the use of tools from the interior volume of the substantially planar main base portion and wherein the refrigeration appliance door bin bottom surface cover covers at least one recess or aperture on a bottom of the refrigeration appliance door bin and the refrigeration appliance door bin bottom surface cover is engaged with at least a portion of the substantially planar main base portion.

2. The refrigeration appliance door bin assembly of claim 1, wherein the door bin frame has a rectangular shape including two side frame members having a width of from about 1 inch to about 2 inches, a front frame member, and a back frame member wherein the front and the back frame members are each a width of from about 0.5 inches to about 1.5 inches, and the front frame member, the back frame member and the side members are interconnected to form the rectangular shape and have a height of from about 1 inch to about 2 inches.

3. The refrigeration appliance door bin assembly of claim 1, wherein the substantially planar door bin base portion comprises a perimeter defining a base section area and has an aperture in a center section of the substantially planar door base portion; and wherein the bottom of the refrigeration appliance door bin comprises at least one recess or aperture on the bottom of the refrigeration appliance door bin and the aperture is defined by a perimeter of an interior perimeter the main base portion; and wherein the aperture on the bottom of the refrigeration appliance door bin has an area that is about 80% of a total surface area defined by an exterior perimeter of refrigeration appliance door bin's at least upwardly extending wall.

4. The refrigeration appliance door bin assembly of claim 1, wherein the at least one upwardly extending wall and the downwardly extending perimeter lip portion are coplanar and form an exterior of the door bin.

5. The refrigeration appliance door bin assembly of claim 1, wherein the door bin bottom surface cover is sized to matingly engage and at least substantially fill a surface area defined by the at least one upwardly extending walls at the substantially planar main base portion.

6. The refrigeration appliance door bin assembly of claim 1, wherein the at least one upwardly extending wall is four upwardly extending side walls with a cross section that is at least substantially the same shape as the shape of the door bin frame and wherein the four upwardly extending side walls do not matingly engage a retention element of a door that secures the refrigeration appliance door bin in engagement with a refrigeration appliance door.

7. The refrigeration appliance door bin assembly of claim 1, wherein the at least one upwardly extending wall comprises four upwardly extending walls where, opposing walls are parallel to one another and have at least side sections of each wall that are the same height.

8. The refrigeration appliance door bin assembly of claim 7, wherein the four upwardly extending walls are free of recesses, apertures or indentations.

9. The refrigeration appliance door bin assembly of claim 1, wherein the at least one upwardly extending wall is four upwardly extending walls that include a front wall, two side walls and a back wall and at least the two side walls are free of recesses, apertures or indentations that project into the interior volume of the refrigeration appliance door bin.

10. The refrigeration appliance door bin assembly of claim 6, wherein the four upwardly extending walls together extends entirely around the interior volume of the door bin and is free of any recesses, aperture or indentations.

11. The refrigeration appliance door bin assembly of claim 1, wherein the door bin frame is disposed in an cabinet door interior volume of a refrigerator and the at least one upwardly extending wall extends entirely around the interior volume of the door bin and is free of any recesses, aperture or indentations.

12. The refrigeration appliance door bin assembly of claim 11, further comprising a main door and an exterior door disposed coaxially on a cabinet of the refrigerator, and wherein the door bin frame is slidably connected to the main door by a sliding mechanism having an overall length, wherein the sliding mechanism allows the door bin to be actuated by a user between an extended position where the refrigeration appliance door bin is extended away from a storage position when the exterior door is open and, when completely extended, is extended at least 80% of the overall length of the sliding mechanism.

13. An appliance comprising:

a door bin frame further comprising at least one door bin frame support member that extends around and defines an aperture; and a door bin comprising:

a substantially planar main base portion;

an upwardly extending wall section extending upward from the substantially planar main base portion that surrounds and defines an interior volume of the door bin; and a downwardly extending perimeter lip portion; and wherein the main base portion and the downwardly extending lip portion define a downwardly facing door bin frame engagement space and the main base portion establishes a door bin frame cavity upper surface and the downwardly extending lip portion establishes an exterior surface of the door bin frame engagement space; the door bin engagement space engages a door bin frame of a refrigerator spaced within a door of a refrigerator such that the downwardly extending lip portion surrounds an exterior portion of the door bin frame and prevents substantial movement of the door bin when the door bin is engaged with the door bin frame caused by a refrigeration appliance door opening force or a refrigeration appliance door closing force; wherein the upwardly extending wall section is free of indentations or recessed portions configured to mate with a portion of an appliance and that project into the interior volume of the bin; and an appliance cabinet having an interior storage area defined by at least a first side wall, a second side wall, a back wall, and a rotatably connected door system comprising a main cabinet door and an exterior door wherein the main cabinet door provides user access to the interior storage area of the appliance cabinet and wherein the exterior door provides access to the door bin when positioned within the rotably connected door system, but not unobstructed access to the interior storage area; and a sliding mechanism assembly comprising an interior facing bracket mounted to at least an interior facing surface of the main cabinet door and slidably engaged to a sliding mechanism, allowing the door bin to extend linearly outward.

14. The appliance claim 13, wherein the sliding mechanism assembly further comprises an exterior facing bracket mounted to an exterior facing surface of the main cabinet door and engaged with the interior facing mounting bracket by a plurality of fasteners through the main cabinet door.

15. The appliance of claim 13, wherein the door bin is configured to be disengaged from the door bin frame by hand and without the use of tools.

16. The appliance claim 13, wherein the interior facing bracket has a length and the door bin frame extends linearly out of the main cabinet door by sixty to ninety percent of length of the interior facing bracket while retaining the door bin in engagement with the door bin frame.

17. The appliance of claim 13, wherein the at least one upwardly extending wall is free of indentations or recessed portions that project into the interior volume of the bin and are configured to mate with a portion of an appliance.

18. The appliance of claim 17, wherein the exterior door is rotatably engaged and on the same axis with the main cabinet door and wherein the door bin is a rectangular cuboid shape with four upwardly extending walls.

19. A method for removing a door bin from a door frame and setting the bin and any contents of the bin on an at least substantially planar surface, the method comprising the steps of:

providing a refrigerator comprising a cabinet, a main cabinet door for allowing access to an interior volume of the cabinet, wherein the main cabinet door with two opposing main cabinet door sides defines an interior door volume and an exterior door that provides access to the interior door volume;

selectively opening the exterior door such that a side of a door bin spaced within the interior door volume faces a user of the refrigerator or opening the main cabinet door such that an opposite side of the door bin faces the user of the refrigerator;

sliding the door bin away from the interior of the cabinet when the exterior door is open, the door bin being removably engaged to a door bin frame attached to a sliding mechanism disposed within the interior door volume; and lifting the door bin by hand and without the use of tools from the door bin frame to disengage the door bin from the door bin frame and remove the door bin from the refrigerator; and setting the door bin on a surface that is not part of the refrigerator to provide convenient access to the door bin and the contents of the door bin;

wherein the door bin has a substantially rectangular cuboid shape where at least two opposing sides of the door bin proximate the main cabinet door sides are free of any indentation, aperture or recess that mates with or engages a movable portion of an appliance.

20. The method of claim 19, wherein the door bin frame is rectangular shape and configured to matingly engage the door bin and the door bin frame defines at least one aperture spaced within a perimeter defined by the exterior of the door bin frame that prevents the door bin frame from functioning as a shelf when the door bin is disengaged from the door bin frame.

* * * * *